US006073941A

United States Patent [19]

Hilgarth

[11] Patent Number: 6,073,941

[45] Date of Patent: Jun. 13, 2000

[54] IN-LINE SKATE WITH DETACHABLE SHOE AND ROLLER UNIT

[75] Inventor: Kurt Hilgarth, Graz-Seiersbach, Austria

[73] Assignee: Fancyform Design Engineering, Graz-Grambach, Austria

[21] Appl. No.: 09/068,538

[22] PCT Filed: Aug. 6, 1997

[86] PCT No.: PCT/AT97/00181

§ 371 Date: May 11, 1998

§ 102(e) Date: May 11, 1998

[87] PCT Pub. No.: WO98/06467

PCT Pub. Date: Feb. 19, 1998

[30] Foreign Application Priority Data

Aug. 9, 1996 [AT] Austria ..... 1440/96

[51] Int. Cl.[7] ..... A63C 1/20; A43B 5/16

[52] U.S. Cl. ..... 280/11.22; 280/11.22; 280/11.27; 36/115

[58] Field of Search ..... 280/11.3, 11.27, 280/11.19, 7.12, 7.13, 11.22, 623, 624; 36/115

[56] References Cited

U.S. PATENT DOCUMENTS

| | | | |
|---|---|---|---|
| 3,797,841 | 4/1974 | McAusland | 280/624 |
| 4,298,209 | 11/1981 | Peters | 280/11.2 |
| 5,199,726 | 4/1993 | Willett | 280/11.27 |
| 5,357,695 | 10/1994 | Lu | 36/115 |
| 5,507,506 | 4/1996 | Shadroui | 280/11.22 |
| 5,676,218 | 10/1997 | Hirose | 180/181 |
| 5,741,018 | 4/1998 | Huang | 280/11.3 |
| 5,971,421 | 10/1999 | Hilgarth | 280/613 |

FOREIGN PATENT DOCUMENTS

| | | | |
|---|---|---|---|
| 399443 | 5/1995 | Austria . | |
| 2706111 | 8/1978 | Germany . | |
| 195 04 498 | 7/1995 | Germany . | |
| 296 08 296 U | 9/1996 | Germany . | |
| 602147 | 6/1976 | Switzerland | 280/11.3 |

*Primary Examiner*—Lanna Mai
*Assistant Examiner*—Andrew J. Ririe
*Attorney, Agent, or Firm*—Jacobson, Price, Holman & Stern, PLLC

[57] ABSTRACT

The invention relates to an inline roller skate consisting of a boot 10, 11, a removable roller unit 1–5, an interface 12 on the boot and a device for locking and unlocking the roller unit 1–5 to and from the interface 12 on the roller unit 1–5. To enable optimum rolling and, after simple removal of the roller unit, also comfortable walking with the boot, the interface 12, which preferably consists of a harder material than the boot body 10, extends upwards from the boot sole 11 laterally along the boot body 10, and the roller unit 1–5 is provided with a substantially horizontal standing plate 4 and substantially vertical side walls 5 for the reception of the interface 12, so that substantially perpendicular stepping into and out of the roller unit 1–5 is created, and the device for locking and unlocking the roller unit 1–5 to and from the interface 12 engages in the interface 12 outside the area of the boot sole 11.

15 Claims, 5 Drawing Sheets

IN-LINE SKATE WITH DETACHABLE SHOE AND ROLLER UNIT

Figure 1:
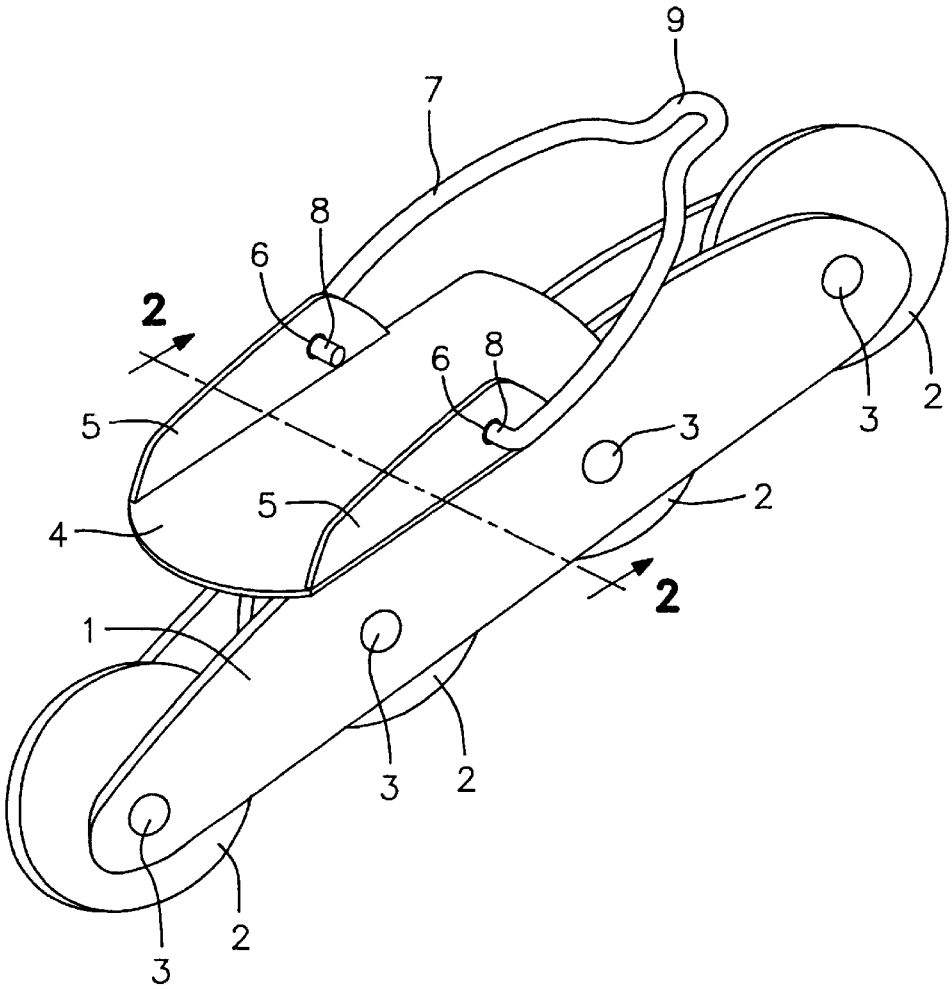

The invention relates to an inline roller skate according to the preamble of claim 1 and also to an interface for the roller unit of such an inline roller skate. The term inline roller skate is understood to mean a one-track roller boot in the widest sense.

In recent years the number of inline roller skates has shown a clear increase. Precisely in the city area, with the traffic density prevailing there, relatively short distances can be covered significantly more quickly with these means of locomotion than with other means of transport. However, for longer distances public means of transport or vehicles are faster and more comfortable. As a result of the prevailing prohibitions of inline roller skates in, for example, underground railway areas the inline roller skater must also carry normal shoes and put these on if required instead of the inline roller skates. For improvement boots have been developed with removable rollers and roller units which can be mounted on normal shoes. However, known systems with removable rollers are usually laborious to assemble and/or provide inadequate steadiness and therefore lack optimum travelling properties.

From U.S. Pat. No. 507 506A (SHADROUI), for example, a roller boot of the kind specified is known which for the purpose of easy and rapid interchangeability of the roller unit on the boot sole is equipped with an interface constructed after the fashion of a channel into which a correspondingly shaped roller support can be inserted. The connection between the roller unit and the boot is locked by a resiliently mounted lever in the heel area. Unlocking is performed by forcing the lever downwards while at the same time displacing the boot in relation to the roller unit. The constructional elements, necessary for the connection to the roller unit, in the form of a channel-like structure on the boot sole can easily become dirty or damaged, so that the boot is not suitable for walking without the roller unit. Moreover, the structures on the boot sole, which must be made from particularly resistant material to achieve adequate resistance, adversely effect walking comfort. The weight of the boot is also increased thereby. Furthermore, stepping in and out is laborious, since the correct positioning of the structure of the roller unit in the channels on the boot sole calls for a certain skill and the boot must be moved in the longitudinal direction of the roller unit and therefore the roller unit would roll away during stepping in and out, so that it must be retained tightly. During stepping out the lever, which is placed very low, must be actuated and the roller unit held at the same time.

An object of the invention is the provision of measures whereby an inline roller skate is created which not only rolling the most optimum travelling properties possible, but also comfortable walking after removal of the roller unit is made possible. Another object is to enable the attachment or "buckling-on" of the roller unit to the boot to be performed as quickly and simply as possible accompanied by the necessary security of the connection. The disadvantages of known systems are to be obviated or at least reduced.

The problem according to the invention is solved by the features that the interface extends upwards from the boot sole laterally along the boot body and preferably consists of a harder material than the boot body, and the roller unit is provided with standing plate substantially horizontal in the position of use and side walls substantially vertical in the position of use for the reception of the interface, so that in the position of use a substantially perpendicular possibility of stepping with the boot into and out of the roller unit is created, and the device for locking and unlocking the roller unit to and from the interface engages in the interface outside the area of the boot sole. According to the invention a commercially available sports shoe with the interface of preferably harder material than the shoe body can be adapted for inline skating. (Translator's note: In this text the German word "Schuh" is used for both "shoe" and "boot", according to circumstances.) The material of the interface and the material of the boot body might also be identical and therefore also have the same hardness. For the reception of the boot use is made of the standing plate and the side walls on the roller unit, which give the boot the necessary steadiness and make possible a simple stepping-in. The boot is locked to the roller unit by suitable constructional measures. As a result, in addition to the necessary security, with the inline roller skate according to the invention optimum travelling properties are also achieved. The inline roller skate according to the invention allows a simple and rapid stepping in and out with the boot into and out of the roller unit in a substantially perpendicular direction—i.e., from above. As a result, the roller unit does not roll away during stepping in and out. Due to the engagement according to the invention of the locking device in the interface outside the sole area, the sole has no constructions which might be dirtied or damaged during walking without the roller unit and adversely affect walking comfort. Comfort in walking without the roller unit is also enhanced by the feature that the device for locking and unlocking the roller unit to and from the boot is attached to the roller unit and therefore no weight-increasing structural members must be attached to the boot. The roller unit of the inline roller skate according to the invention with the substantially horizontal standing plate and the substantially vertical side walls with the locking device is relatively small and can therefore easily be accommodated, for example, in a bag when not in use. The construction according to the invention also makes possible a cheap and therefore economic manufacture of the roller unit and the boot.

Advantageously, the interface extends along a central longitudinal portion of the boot sole laterally along the boot body upwards and at least partially conically outwards. As a result the necessary flexibility of the boot sole remains preserved in the front and rear area of the boot, while the interface confers on the boot the necessary strength for a secure and stable connection to the roller unit of the inline roller skate. Due to the conical shaping, stepping into the binding is even further facilitated.

A simple and cheap connection between the boot body and the interface is achieved by the feature that the interface is provided with eyelets or the like and can also be bound together with the boot strap.

If necessary, the interface can be connected preferably via a link to a collar, for example, around the upper of the boot or the like of a preferably harder material than the boot body, whereby the travelling properties in inline roller skating are improved. Naturally, the material of the collar can also be identical with that of the interface and of the boot body and therefore also have the same hardness.

Advantageously, the interface is connected to the boot by sewing, gluing, welding or in similar manner. As a result a more secure retention (steadiness) of the boot in the binding of the roller unit is achieved.

An optimum connection is achieved if the interface and any collars or the like are integrated in the boot. The integration of an interface according to the invention can therefore be taken into account in the manufacture of a sports shoe.

By a construction of the standing plate of the roller unit which is adjustable in height the binding can be enabled to be adapted to different boot soles.

A further possibility of adaptation of the binding to different boots is achieved by the feature that at least one of the two side walls can be adjusted transversely of the running direction and is preferably fixed in the adjusted position, or the two side walls are connected to one another via a spring or the like.

Advantages are obtained from the manufacturing aspect if the roller support, the standing plate and the side walls are formed in one piece by a profile (section). Since in this case connecting places between the individual structural members are eliminated, such a structural member also possesses the best strength properties.

Advantageously, the device for locking and unlocking the roller unit to and from the boot engages in lateral, substantially horizontal holes in the interface. This represents a very simple locking possibility which is therefore easy and cheap to manufacture.

Stepping with the boot into the binding can be further facilitated if a corresponding guide is provided for the boot by side walls diverging upwards and conically upwards at least in the upper portion.

According to another feature of the invention the device for locking and unlocking the roller unit to and from the boot is formed by a pivotable sprung clamp whose ends or elements such as, for example, bolts or the like connected to the ends extend inwardly through substantially horizontal holes in the side walls of the roller support, the ends of the sprung clamp or elements such as, for example, bolts or the like connected thereto engaging in the holes in the interface in the locked position of the sprung clamp unlocking being performed by the pivoting of the sprung clamp. The binding is fixed in position by the side walls, thus facilitating the precise placing of the boot in the binding. When stepping into the binding, the sprung clamp is pressed apart and finally the ends of the sprung clamp or elements such as, for example, bolts or the like connected thereto, latch into devices provided for this purpose in the interface of the boot and therefore lock the boot to the binding and the roller unit. For stepping-out the sprung clamp is pivoted, preferably pressed downwards and then by, for example, corresponding shaping of the side walls the sprung clamp is forced apart thereby the ends of the sprung clamp or the elements such as, for example, bolts or the like connected thereto, are drawn out of the locking devices of the interface of the boot, whereafter the boot can be unlocked and separated from the roller unit. This kind of binding represents a simple and secure possibility for the connection of the boot to the roller unit.

For the simpler manual pivotability of the sprung clamp, preferably at its place extending furthest away from the boot, the sprung clamp is connected to a preferably upwardly pointing bowed portion or the like or is constructed as such.

If the ends of the sprung clamp are displaceably connected to the elements which extend into the holes in the side walls, and if the sprung clamp can be displaced in the longitudinal direction of the inline roller skate for adaptation to the boot size, the sprung clamp will bear against the boot in the locked position or latch into a corresponding notch in the heel area of the boot above the boot sole. On the other hand the sprung clamp, exactly adapted to the boot size, can be used as an additional stepping-in aid which facilitates the correct positioning of the boot in the binding.

By a corresponding constructional shaping the sprung clamp and if necessary the bowed portion can be used in a downwardly pivoted position as stands for the roller unit. The unbuckled roller units can as a result be stored in an orderly fashion.

It is a further object of the invention to create for the roller unit of an inline roller skate as described herein before an interface which enables the roller unit to be transported or stored.

This second problem according to the invention is solved by an interface for the roller unit of an aforementioned inline roller skate which is characterised in that the device for locking and unlocking the roller unit engages in the interface, and the interface can be attached, for example, to a rucksack, a bag or the like for the transportation of the roller unit or to a wall or the like for the storage of the roller unit.

Advantageously, the device for locking and unlocking the roller unit engages in holes disposed laterally in the interface. In a similar manner to that by which the roller unit is locked to the boot equipped with an interface, the roller unit is also locked to such an interface for transportation or storage.

Figure 2A:
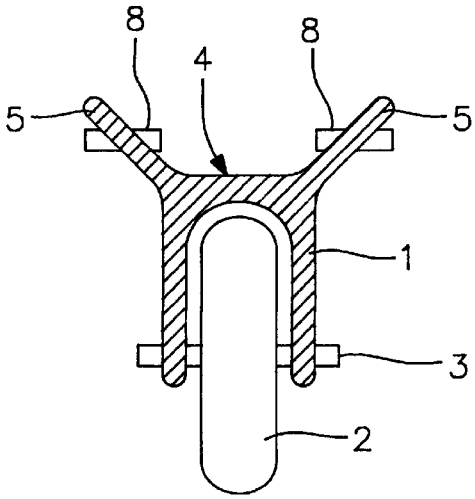
Figure 2B:
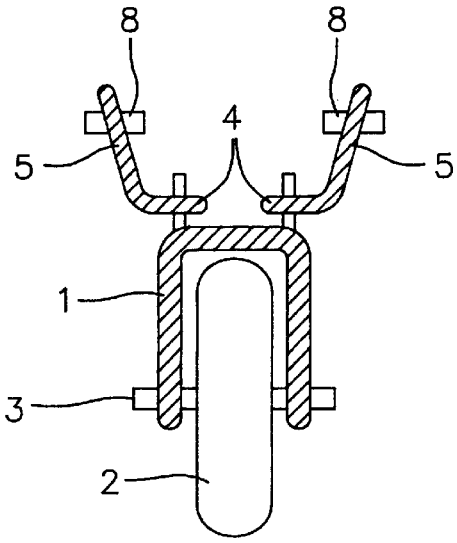
Figure 5:
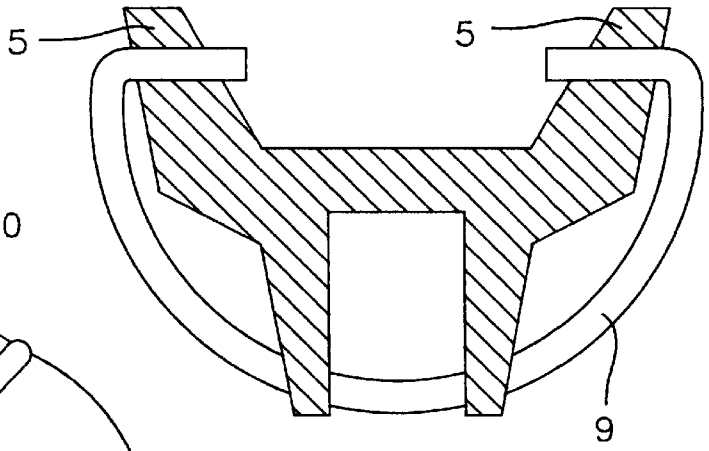
Figure 3:
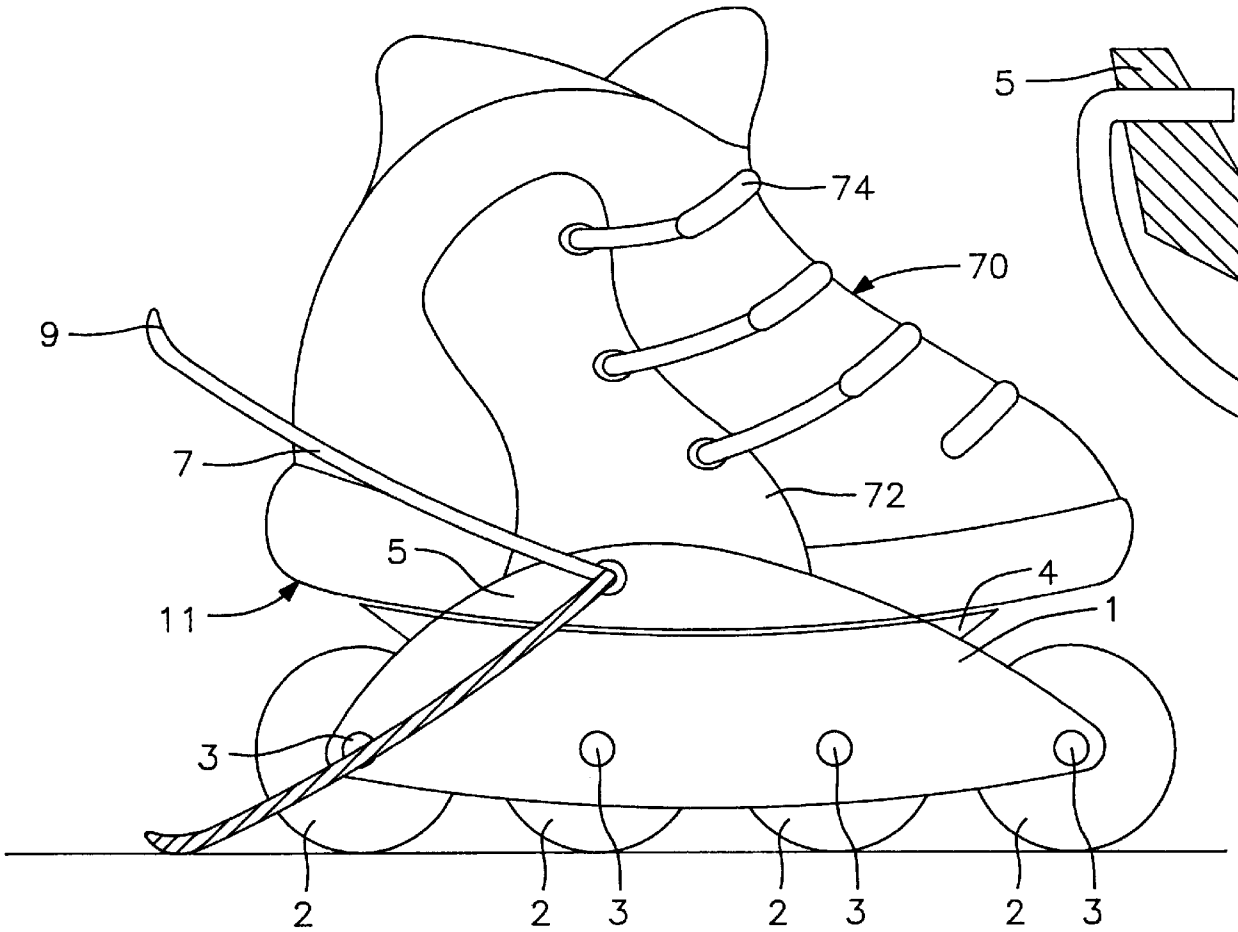
Figure 4B:
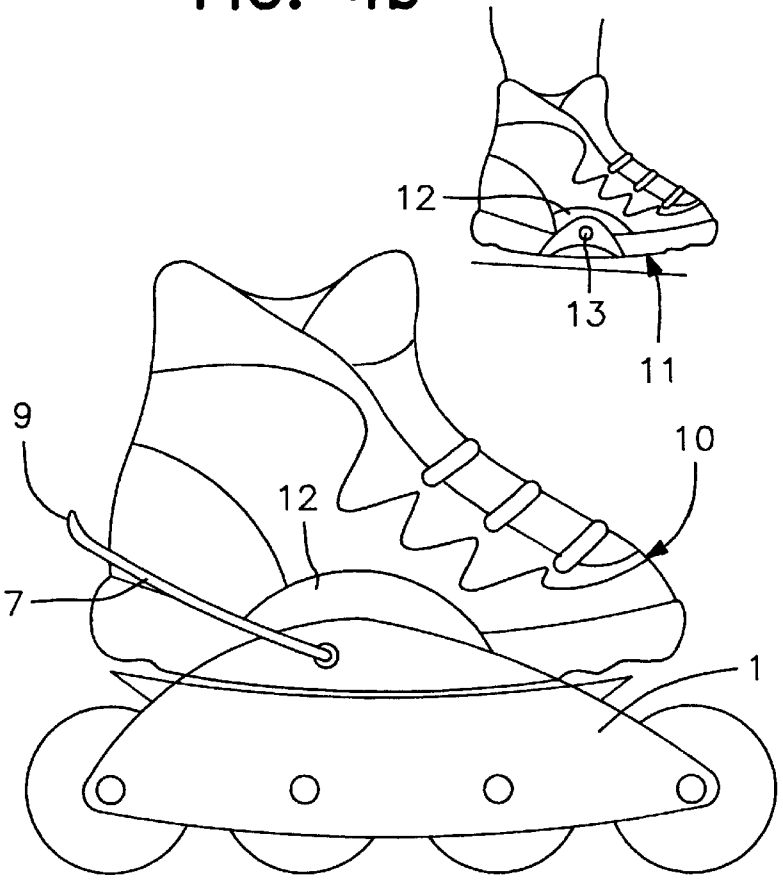
Figure 4A:
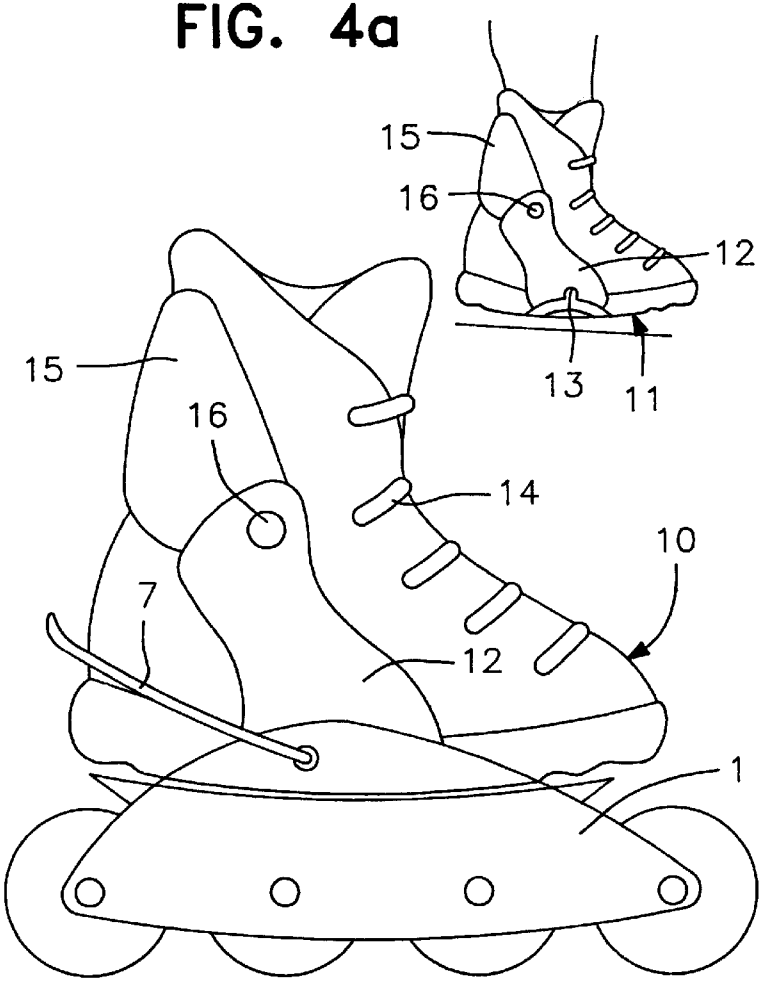
Figure 6:
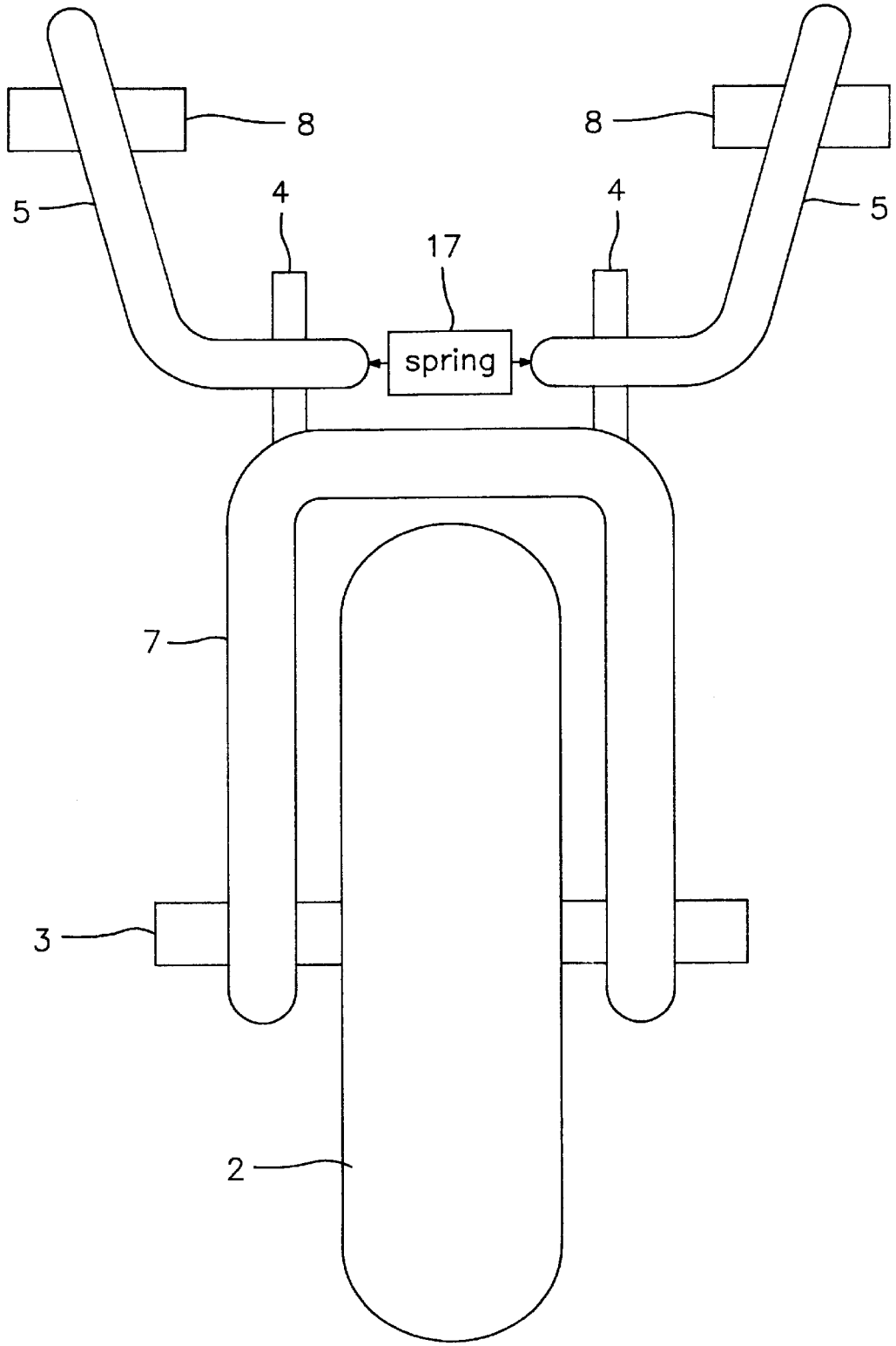
Figure 7:
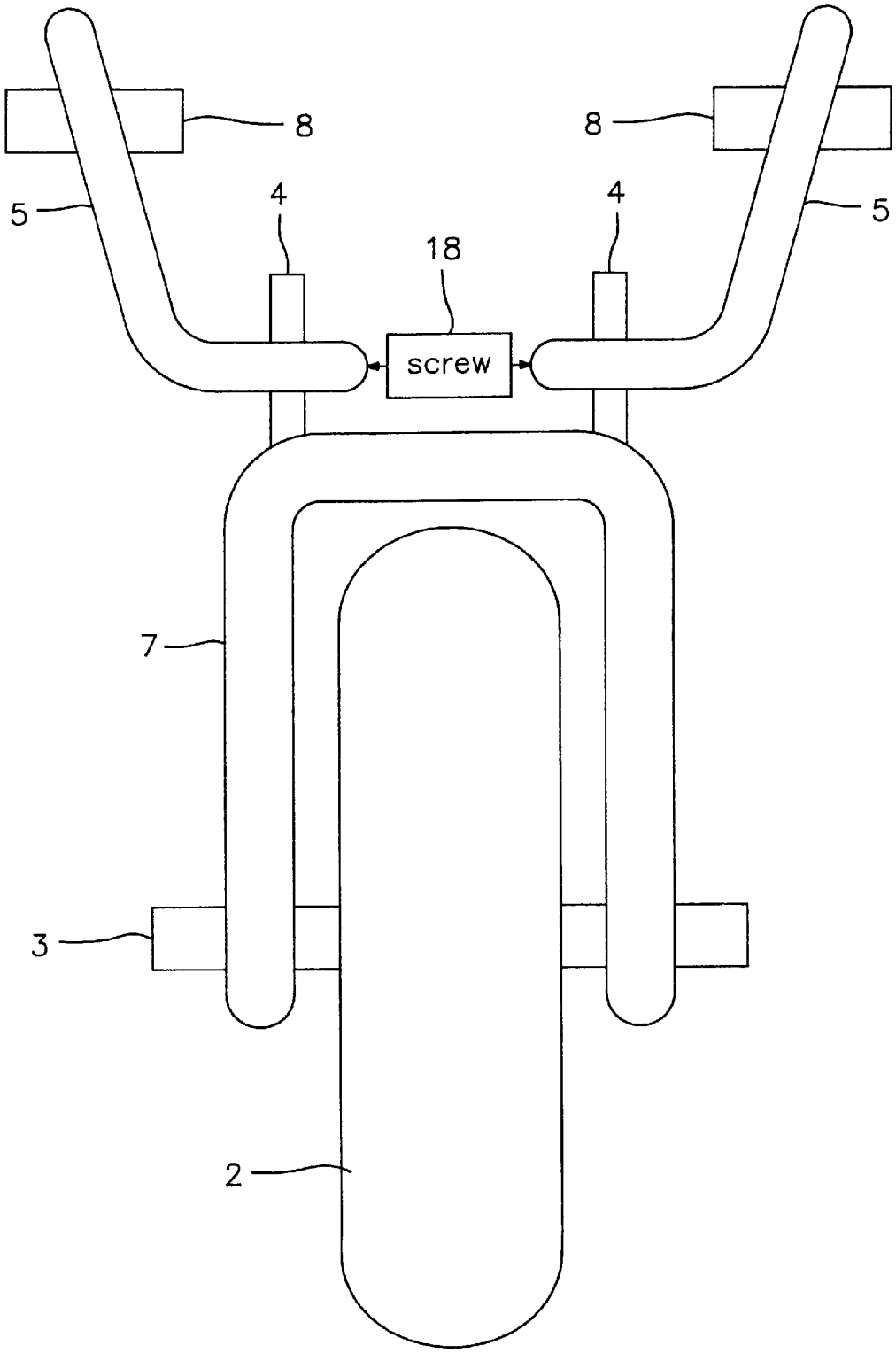

The features of the invention will be explained in greater detail with reference to the accompanying drawings, which show:

FIG. 1—a perspective view of a roller support for inline roller skates with the binding according to the invention, FIGS. 2*a* and 2*b*—a sectional drawing of two embodiments of the roller support with binding, FIG. 3—an inline roller skate with buckled-on boot, FIGS. 4*a* and 4*b*—two further embodiments of boots with buckled-on rollers FIG. 5—a sectional drawing of another variation of the standing plate showing the side walls diverging from one another upward and outward at least in their upper portion, FIG. 6—a sectional drawing of another variation of the standing plate showing the two side walls connected to one another via a spring illustrated by a box labeled "spring", and FIG. 7—a sectional drawing of another variation of the standing plate showing the two side walls adjustable transversely of the running direction and fixable in the adjusted portion illustrated by a box labelled "screw".

In the perspective view of an embodiment of the roller support with binding for the inline roller skate according to the invention as shown in FIG. 1, four rollers 2 are mounted via axles 3 on a roller support 1. This construction must be regarded as an example. Naturally, without exceeding the scope of the invention fewer or more rollers are also possible and also other means of locomotion such as, for example, skids or cylinders. Mounted on the roller support is a standing plate 4 which is bounded by two lateral, substantially horizontal side walls 5. The connections between the roller support 1 and the standing plate 4 and also the standing plate 4 and the side walls 5 respectively can be effected by gluing, welding or the like. The side walls 5 provide the boot with the necessary support and facilitates stepping into the binding. Stepping in is even further facilitated if the side walls 5 diverge from one another conically upwards at least in the upper portion as shown in FIG. 5. In the embodiment illustrated the binding of the inline roller skate consists of a pivotable sprung clamp 7, whose open ends 8 are prestressed towards one another and extend inwardly through substantially horizontal holes 6 in the side walls 5. The ends 8 of the sprung clamp 7 extend into corresponding devices, preferably holes in the boot or devices connected thereto and lock the boot to the binding. The portion of the sprung clamp 7 extending furthest away from the binding is designed in the form of a bowed portion 9 which facilitates the actuation of the sprung clamp 7. Instead of a sprung clamp 7 being designed in the form of a bowed portion 9 or the like, a corresponding element can also be connected to the sprung clamp 7. By the actuation of the sprung clamp 7, preferably by pressing downwards, due to, for example, corresponding shaping of the outer surfaces of the side walls 5 the sprung clamp 7 is forced apart and thereby its ends 8 are forced apart. As a result the locked boot is released and can be lifted out of the binding. Instead of the inwardly bent free ends 8 of the sprung clamp 7, other elements also such as, for example, bolts, which are connected to the ends 8 of the sprung clamp 7, can extend into the holes 6 in the side walls 5 and be used for locking the boot and devices connected thereto. Advantageously the sprung clamp 7 can be displaced in relation to these elements, for example, bolts, whereby adaptation of the sprung clamp to different boot sizes is possible.

The sectional representation shown in FIG. 2*a* shows a preferred design of the roller support 1 with the binding in the form of a profile (section). The roller support 1, the standing plate 4 and the side walls 5 are made in one piece. This structural member is advantageously from a material which is as light as possible, but resistant such as, for example, aluminium or plastics. FIG. 2*b* shows a diagrammatic drawing of the roller support 1 with the binding, the side walls 5 being displaceable. The displaceability can be achieved by any desired measures. The side walls 5 can preferably be fixed in the adjusted position. This can be done, for example, with screws 18 or the as schematically illustrated by a box labeled "screw" in FIG. 7. The side walls may be connected to each other via a spring. A connection of the side walls to, for example, a spiral spring as schematically illustrated by a box labeled "spring" in FIG. 6 would be conceivable.

FIG. 3 shows the inline roller skate according to the invention with a buckled-on boot. The central zone of the sole 11 of the boot body 10 is provided with an interface 12 which extends upwards laterally along the boot body 10 and is connected, for example, sewn, glued, welded or the like thereto. The interface 12 consists of a preferably harder material than the remaining boot body 10. This ensures a firm hold (steadiness) of the boot in the binding. On the other hand the necessary flexibility of the boot in the front and rear zone of the sole 11 remains preserved and enables walking with this boot. Commercially available sports shoes which are provided with this interface 12 can therefore be used for inline roller skating, without essential losses in travelling properties in comparison with pure inline roller skating with a fixed connected boot body. The wearer of the inline roller skate according to the invention can therefore both skate and also walk with the same pair of shoes, without having to take along a second pair of shoes as well. Naturally, the interface 12 can also be integrated in the boot body 10 and taken into account during its manufacture. The interface 12 can also be bound together with the boot straps 14. The boot stands in the binding with its sole on the standing plate 4 and is retained laterally by the side walls 5. The ends of the sprung clamps 7, which extend through the holes 6 in the side walls, engage in a preferably upper position of the sprung clamp 7 in corresponding devices such as, for example, holes 13 in the interface 12 of the boot and lock the boot to the roller unit. In the locked state the sprung clamp 7 and the bowed portion 9 can latch into a notch in the heel area of the boot above the boot sole 11, on condition that the sprung clamp 7 is adapted to the boot size. By preferably pressing the sprung clamp 7 downwards by pressure on the bowed portion 9 the sprung clamp is tensioned, for example, by corresponding formations on the outer surface of the side walls 5, whereby the ends 8 of the sprung clamp 7 or elements connected thereto are drawn out of the, for example, holes 13 in the interface 12 and the boot is unlocked. In the case of walking the unbuckled roller supports 1 with binding can be attached, for example, to a rucksack. At the same time, the sprung clamp 7 and the bowed portion 9 can be used for suspension from corresponding holding means on the rucksack. According to another feature of the invention, similar to the interface 12 of the boot, it is also possible for there to be mounted on, for example, the rucksack or the like an attaching unit on which the unbuckled roller supports are placed and are locked in the same manner as to the interface 12 of the boot. If required, these attaching units can also be mounted at various other places and be used there for the simple and orderly storage of the roller supports. Actionable places are on walls, boxes, shelves or the like, but also on motor cars, bicycles, etc. With a corresponding constructional shaping of the sprung clamp 7 and the bowed portion 9, these can function as "wheel stands" in the downwardly pivoted position of the sprung clamp 7, whereby the roller units can be quasi "parked".

FIGS. 4*a* and 4*b* show two further embodiments of boots with roller units. At the top right in each drawing the unbuckled boot is shown somewhat reduced in size. FIG. 4*a* shows the variant on a boot on which the interface 12 is connected via a link 16 to a collar 15 which is laid around the rear portion of the boot. Just like the interface 12, the collar is made from a preferably harder material than the remaining boot body 10 and therefore provides increased support. In FIG. 4*b* the interface 12 of the boot is shown constructed very small. As a result, no extremely rigid connection of the boot to the roller unit is possible, but on the other hand the walking properties of the boot on their own are substantially more comfortable, since the elasticity of the boot is not substantially adversely affected by the interface 12. Visually the boot shown in FIG. 4*b* is very similar to a normal sports shoe. The objective is therefore to find the ideal compromise between optimum walking and travelling properties and also visual design, in dependence on application and the wish of the customer in each case.

The subject matter of the invention can also be applied, for example, to ice skates or normal roller skates.

I claim:

1. An inline roller skate, consisting of a boot with a boot body (10) and a boot sole (11), a roller unit (1–5) with a roller support (1) and wheels (2) rotatably mounted thereon, an interface (12) disposed on the boot for the releasable connection of the roller unit (1–5) to the boot, and a device attached to the roller unit (1–5) for locking and unlocking the roller unit (1–5) to and from the interface (12), characterised in that the interface (12) extends from a central longitudinal portion of the boot sole (11) laterally along the boot body (10) upwards and at least partially outwards side walls (5) of the roller support (1) diverge from one another upwards and outwards at least in their upper portion, the roller unit (1–5) is provided with a standing plate (4) substantially horizontal in the position of use and the side walls (5) substantially vertical in the position of use for the reception of the interface (12) so that in the position of use a substantially perpendicular possibility of stepping with the boot into and out of the roller unit (1–5) is created, the device for locking and unlocking the roller unit (1–5) to and from the boot is formed by a pivotable sprung clamp (7) whose ends (8) or elements extend inwardly through substantially horizontal holes (6) in the side walls (5) of the roller support (1) and the ends (8) or elements of the sprung clamp (7) engage in holes (13) in the interface (12) in the locked position of the sprung clamp (7), unlocking being performed by pivoting of the sprung clamp (7).

2. An inline roller skate according to claim 1 or 2, characterised in that the interface (12) is provided with eyelets and can also be bound together with a boot strap (14).

3. An inline roller skate according to claim 1, characterised in that the interface (12) is connected to the boot by sewing, gluing, or welding.

4. An inline roller skate according to claim 1, characterised in that the interface (12) and a collar (15) are integral in the boot.

5. An inline roller skate according to claim 1, characterised in that at least one of the two side walls (5) can be adjusted transversely of a running direction and is fixed in the adjusted position.

6. An inline roller skate according to claim 1, characterised in that the roller support (1), the standing plate (4) and the side walls (5) are formed in one piece by a profile (section).

7. An inline roller skate according to claim 1, characterised in that the device for locking and unlocking the roller unit (1–5) to and from the boot engages in lateral, substantially horizontal holes (13) in the interface (12).

8. An inline roller skate according to claim 1, characterised in that the sprung clamp (7) can be displaced in the longitudinal direction of the inline roller skate for adaptation to the boot size.

9. An inline roller skate according to claim 1, characterised in that the sprung clamp (7) can be used in a downwardly pivoted position as a stand for the roller unit (1, 2, 3).

10. An inline roller skate according to claim 1, characterized in that the two side walls (5) are connected to one another via a spring.

11. An inline roller skate according to claim 1, characterised in that the interface (12) is connected to a collar (15), around the upper of the boot.

12. An inline roller skate according to claim 11, characterized in that the interface (12) is connected via a link (16) to a collar (15).

13. An inline roller skate according to claim 11, characterized in that the upper of the boot is made of a harder material than the boot body (10).

14. An inline roller skate according to claim 1, characterised in that at its place extending furthest away from the boot, the sprung clamp (7) is connected to a bowed portion (9).

15. An inline roller skate according to claim 14, characterized in that the bowed portion (9) is upwardly pointing.

* * * * *